United States Patent [19]

Janssen et al.

[11] Patent Number: 4,857,709

[45] Date of Patent: Aug. 15, 1989

[54] ELECTRIC COOKING UNIT HAVING AN ELECTRIC LAMP WITH A HELICAL FILAMENT IN CONTACT WITH THE LAMP VESSEL WALL

[75] Inventors: Eduard J. P. Janssen; Victor R. Notelteirs, both of Turnhout, Belgium

[73] Assignee: U.S. Philips Corporation, New York, N.Y.

[21] Appl. No.: 181,880

[22] Filed: Apr. 15, 1988

[30] Foreign Application Priority Data

Apr. 15, 1987 [NL] Netherlands ..... 8700886

[51] Int. Cl.[4] ..... H05B 3/74

[52] U.S. Cl. ..... 219/464; 313/579; 219/465

[58] Field of Search ..... 219/464, 465, 466, 467, 219/458, 354; 338/234–237; 313/578, 579, 315, 569

[56] References Cited

U.S. PATENT DOCUMENTS

| | | | |
|---|---|---|---|
| 3,470,410 | 9/1969 | Patsch | 313/579 |
| 3,699,309 | 10/1972 | Eck | 338/234 |
| 3,940,650 | 2/1976 | Janssen | 313/578 |
| 4,119,832 | 10/1978 | Audesse | 338/237 |
| 4,556,786 | 12/1985 | Frost | 313/315 |

FOREIGN PATENT DOCUMENTS

| | | | |
|---|---|---|---|
| 487460 | 10/1952 | Canada | 219/354 |
| 0169143 | 1/1986 | European Pat. Off. . | |
| 0193981 | 9/1986 | European Pat. Off. | 219/354 |
| 1069794 | 9/1959 | Fed. Rep. of Germany . | |
| 1273023 | 5/1972 | United Kingdom . | |

*Primary Examiner*—Teresa J. Walberg

*Attorney, Agent, or Firm*—Brian J. Wieghaus

[57] ABSTRACT

An electric cooking unit having a housing having a base wall and side walls provided with apertures. The unit further has an IR lamp with a tubular glass lamp vessel, which is sealed in a vacuum-tight manner and in which a tungsten filament is arranged, whose turns directly engage the wall of the lamp vessel. During operation, the filament has a temperature lying between approximately 1200° C. and approximately 1500° C.

10 Claims, 2 Drawing Sheets

ELECTRIC COOKING UNIT HAVING AN ELECTRIC LAMP WITH A HELICAL FILAMENT IN CONTACT WITH THE LAMP VESSEL WALL

BACKGROUND OF THE INVENTION

The invention relates to an electric cooking unit comprising an electric IR lamp supported in a housing. The housing is provided with a base wall and side walls arranged on said base wall, said side walls having apertures. The electric IR lamp comprises

- a tubular lamp vessel sealed in a vacuum-tight manner and consisting of glass having an $SiO_2$ content of at least 95% by weight,
- a tungsten filament in the lamp vessel having helical turns, and
- current supply conductors extending from the filament to the exterior of the lamp vessel.

The lamp vessel being arranged in the housing so that its ends project through the apertures in the side walls to the outside. The invention further relates to an electric cooking apparatus provided with such a cooking unit.

Such an electric cooking unit is known from EP No. 0,169,643 A1.

Such electric cooking units have one or more halogen infrared (IR) lamps, which during operation at design voltage consume a power in the range of approximately 450 to approximately 850 W. This power should be consumed with a comparatively small lamp length. As a result, the power consumption has a high value of approximately 20 to approximately 30 W/cm$^2$ of radiating surface area. The filament has during operation a comparatively high temperature of approximately 1800° C. This is in contrast with the temperature of conventional heating elements of, for example, chromium/nickel or chromium/nickel/iron/aluminium, which have an operating temperature of approximately 1000° C. and are used in the open air. Such heating elements consume only a few watts per cm, however, and further have a comparatively short life of approximately 1000 hours.

The high operating temperature of the known IR lamps results in that the lamps emit a comparatively large quantity of light, i.e. approximately 5 to 6 lm/W. A lamp of, for example, 500 W therefore produces an unfavourably high luminous flux of approximately 2750 lm, which corresponds to the luminous flux of a GLS lamp of approximately 230 W. Known electric cooking units are therefore generally used under a hot plate of very dark color in order to absorb the light produced at least for the major part in said hot plate.

SUMMARY OF THE INVENTION

The invention has for its object to provide an electric cooking unit of the kind described in the opening paragraph, which has per Watt of consumed power a considerably smaller light production, but nevertheless can consume a high power and which further has a very simple construction.

According to the invention, this object is achieved in an electric cooking unit of the kind described in the opening paragraph in that

- the turns of the tungsten filament directly engage the wall of the lamp vessel and
- the filament has during operation a temperature lying between approximately 1200° C. and approximately 1500° C.

The coherent measures taken in accordance with the invention permit of attaining the object aimed at, but moreover provide a cooking unit having a very long life of several thousands of hours. Due to the low temperature the filament has during operation at design voltage, the filament can engage without any objection the wall of the lamp vessel of, for example, quartz glass. The turns consequently have a considerably larger diameter, comparable with the inner diameter of the lamp vessel, than if the filament should be held centered in the middle of the lamp vessel, as is the case with the lamp of the known cooking unit. This larger diameter of the turns permits of accommodating a greater length of tungsten wire in the filament, as a result of which the comparatively low temperature is attained.

At temperatures of the filament lying well below 1200° C., the cost price of the lamp considerably increases because of the increasing weight of the filament. The time required for the lamp to reach the desired, final temperature is then also considerably longer.

At temperatures considerably exceeding 1500° C., the glass of the lamp vessel is excessively heated.

A very favorable property of the unit according to the invention is its very simple construction, as a result of which it can be very readily manufactured.

GB No. 1,273,023 discloses a cooking unit having a tubular lamp which is curved into the form of the arc of a circle and has ends extending beside each other. The filament then extends coaxially with the tube at the center thereof. For this purpose, a large number of supports must be provided on the filament. These supports lead to an increase of the cost price of the lamp. Furthermore, it has proved to be difficult to arrange a filament with supports in a lamp vessel having such a shape because the supports then act as barbed hooks and the filament is thereby liable to be deformed.

On the contrary, during the manufacture of the cooking unit according to the invention, the filament can be very readily provided in the lamp vessel due to the fact that the filament readily slides through the tube, for example under the influence of its weight. A curved IR lamp, which is curved, for example, into the form of the arc of a circle, is favorable because with one or more of these lamps a more uniform heating is obtained of a pan placed on a hot plate with which the cooking unit is used.

The cooking unit has a very low light output of less than approximately 1 lm/W, for example of 0.1 or 0.5 lm/W, depending upon the temperature of the filament. A unit comprising a lamp of 500 W emits at 0.5 lm/W same quantity of light as a GLS lamp of approximately 25 W. As a result it is no longer necessary to use the cooking unit under a dark colored hot plate. An advantage is further that the cooking unit according to the invention emits a comparatively large quantity of long-wave infrared radiation, which has a larger penetration depth.

DE No. 1,069,794B indicates that it is advantageous if a filament of an IR lamp does not touch the lamp vessel. A filament of which each turn has an elliptical, a triangular or a quadrangular cross-section has therefore according to this Patent Specification too many contact points with the lamp vessel. The larger the contact surface of the filament and the lamp vessel, the larger the heat transfer by conduction from the filament to the lamp vessel will be. However, an increase in temperature of the lamp vessel involves heating of the air immediately surrounding the lamp. The radiation efficiency of the IR lamp consequently decreases.

However, it has now surprisingly been found that the cooking unit according to the invention does not operate less satisfactorily than the known cooking unit. It has been found that a cooking unit provided with two known straight IR lamps of 500 W, each arranged under a hot plate, brought two liters of water in a pan to the boil in 18 minutes. In the same arrangement, a cooking unit according to the invention provided with two straight IR lamps of 500 W each brought 2 liters of water to the boil in 17 minutes.

The invention further relates to an electric cooking apparatus comprising a hot plate transmitting IR radiation, under which an electric cooking unit according to the invention is arranged so that the IR lamp faces this plate.

A reflector cooperating with the IR lamp may be present in the housing of the cooking unit. In the housing, a thermal isolator may be arranged along the walls in order to keep the surroundings of the housing cool. It is also possible that both an isolator and one or more reflectors are present.

BRIEF DESCRIPTION OF THE DRAWINGS

Embodiments of the invention are shown in the drawing. In the drawing.

DESCRIPTION OF THE PREFERRED EMBODIMENT

Figure 1:
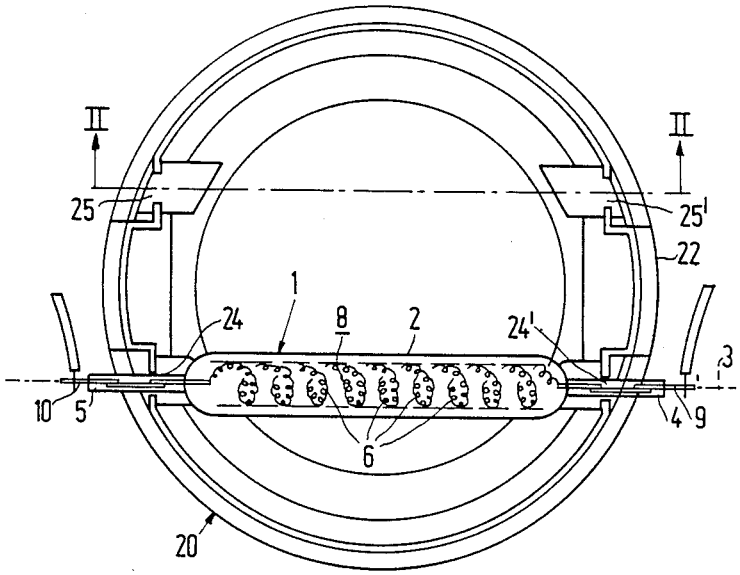
FIG. 1 shows in plan view an embodiment of the cooking unit.
Figure 2:
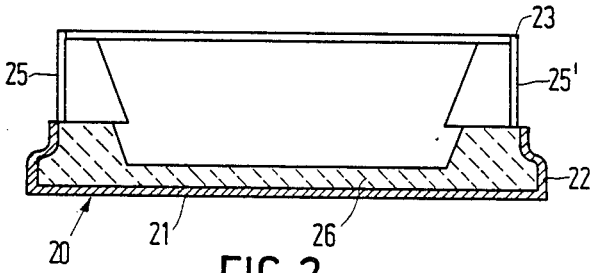
FIG. 2 is a sectional view taken on the line II—II in FIG. 1.

In FIG. 1, the cooking unit has a housing 20 provided with a base wall 21 (FIG. 2) and with side walls 22, which are arranged on said base wall and have apertures 24, 24', 25, 25'. In the housing 20, a thermal isolator 26 of soft ceramic material (FIG. 2) is arranged along the walls 21, 22.

An electric IR lamp provided with a tubular lamp vessel 2 sealed in a vacuum-tight manner and consisting of glass having an $SiO_2$ content of at least 95% by weight with an axis 3 is arranged in the housing 20 so that its ends 5, 4 project through the apertures 24, 24' in the side walls 22. A filament 8 having helical turns 6 is accommodated in the lamp vessel 2. Current supply conductors 9, 10 extend from the filament 8 to the exterior of the lamp vessel 2.

The helically coiled turns 6 of the tungsten filament 8 directly engage the wall of the lamp vessel 2. The filament has during operation at design voltage a temperature lying between approximately 1200° C. and approximately 1500° C.

Figure 3:
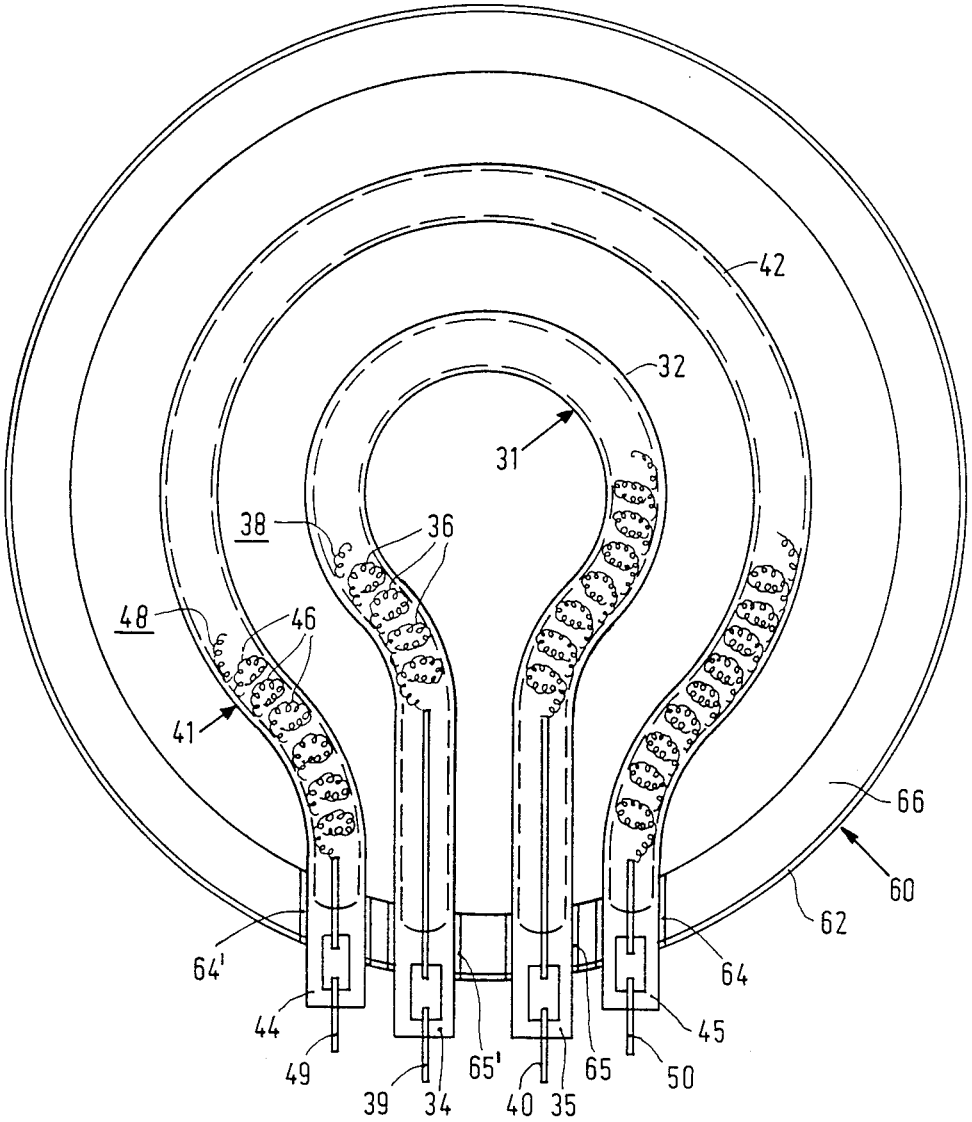
FIG. 3 shows in plan view a second embodiment of the cooking unit.

The cooking unit shown in FIG. 3 has a housing 60 provided with apertures 64, 64', 65, 65' in the side walls 62 and a thermal isolator 66 along the walls 62 in the housing.

Lamps 31, 41 having tubular quartz glass lamp vessels 32 and 42, respectively, curved into the form of the arc of a circle comprise a coiled coil tungsten filament 38 and 48, respectively, whose helically coiled turns 36 and 46, respectively, directly engage on all sides the wall of the lamp vessel 32 and 42, respectively. The lamps 31, 41 have current supply conductors 39, 40 and 49, 50, respectively, and ends 34, 35 and 44, 45, respectively, which project to the outside through apertures 65, 65' and 64, 64', respectively, in the side walls 62. The lamps 31, 41 have a halogen-containing gas filling, for example of Ar containing 0.2% by volume of $CH_2Br_2$ and 0.15% by volume of $CH_3I$ at a pressure up to 1 bar. The filaments have at design voltage an operating temperature of 1300° C. and produce 0.38 lm/W. They consume 20 $W.cm^2$ of radiating surface area.

Figure 4:
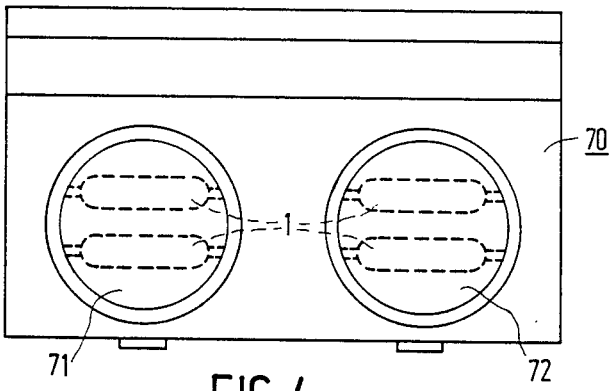
FIG. 4 shows in plan view an embodiment of the cooking apparatus.

In FIG. 4, an electric cooking apparatus 70 has two hot plates 71, 72 of a material transmitting IR radiation, under which a respective electric cooking unit is arranged so that IR lamps 1 face said hot plates 71, 72.

What is claimed is:

1. An electric cooking apparatus, comprising:

an electric infrared lamp, said lamp comprising a tubular glass lamp envelope having a pair of ends, a pinch seal at each end sealing said envelope in a gas-tight manner, said lamp envelope comprising glass having an $SiO_2$ content of at least 95% by weight and having an inner surface having a circular cross section, a helically coiled filament disposed within said lamp envelope, said filament having an outer diameter chosen such that said filament contacts said inner surface of said lamp envelope along a helical path defined by said filament for supporting said filament within said lamp envelope, said filament comprising tungsten wire having a predetermined diameter and being free of any heat insulative coating, the length of said filament and the diameter of said filament wire being chosen such that said filament has a temperature during lamp operation of between approximately 1200 degrees Celsius and 1500 degrees Celsius, and a pair of current-supply conductors each connected to said filament, passing through a respective pinch seal and extending away from said lamp envelope; and a housing in which said lamp is disposed, said housing comprising a base, and a wall portion having a pair of apertures shaped and positioned for receiving a respective pinch seal of said lamp envelope for supporting said lamp envelope in said housing.

2. An electric cooking unit as claimed in claim 1, wherein the tubular lamp vessel is curved.

3. An electric cooking unit as claimed in claim 2, wherein the tubular lamp vessel is curved into the form of the arc of a circle and its ends extend beside each other.

4. An electric cooking apparatus as claimed in claim 3, wherein said cooking apparatus further comprises a plate disposed opposite said base and facing said lamp which plate is transmissive to infrared radiation.

5. An electric cooking apparatus as claimed in claim 2, wherein said cooking apparatus further comprises a plate disposed opposite said base and facing said lamp which plate is transmissive to infrared radiation.

6. An electric cooking apparatus as claimed in claim 1, wherein said cooking apparatus further comprises a plate disposed opposite said base and facing said lamp which plate is transmissive to infrared radiation.

7. An electric infrared lamp, comprising:

a tubular glass lamp envelope sealed in a gas-tight manner and having a pair of sealed ends, said lamp envelope comprising glass having an $SiO_2$ content of at least 95% by weight and having an inner surface having a circular cross section;

a helically coiled filament disposed within said lamp envelope, said filament having an outer diameter chosen such that said filament contacts said inner surface of said lamp envelope along a helical path defined by said filament for supporting said filament within said lamp envelope, said filament comprising tungsten wire having a predetermined diameter and being free of any heat insulative coating, the length of said filament and the diameter of said filament wire being chosen such that said filament has a temperature during lamp operation of between approximately 1200 degrees Celsius and approximately 1500 degrees Celsius.

8. An electric infrared lamp as claimed in claim 7, wherein said filament is a coiled-coil filament.

9. An electric infrared lamp as claimed in claim 8, wherein said lamp envelope is curved into an arc of circle and said sealed ends are arranged besides each other.

10. An electric infrared lamp as claimed in claim 7, wherein said lamp envelope is curved into an arc of circle and said sealed ends are arranged besides each other.

* * * * *